United States Patent [19]

Buehler

[11] Patent Number: 4,556,889

[45] Date of Patent: Dec. 3, 1985

[54] AIRCRAFT TRAILING BALL ANTENNA

[75] Inventor: Walter E. Buehler, Issaquah, Wash.

[73] Assignee: The Boeing Company, Seattle, Wash.

[21] Appl. No.: 537,845

[22] Filed: Sep. 30, 1983

[51] Int. Cl.[4] ..... H01Q 1/30; H01Q 15/24

[52] U.S. Cl. ..... 343/707; 343/756; 343/790; 343/898

[58] Field of Search ..... 343/707, 709, 745, 705, 343/790–792, 807, 711, 898, 899, 905, 909, 756, 830, 862

[56] References Cited

U.S. PATENT DOCUMENTS

| | | | |
|---|---|---|---|
| Re. 21,764 | 4/1941 | Irvin | 343/707 |
| 2,278,531 | 4/1942 | Buschbeck | 343/723 |
| 2,451,258 | 10/1948 | Trevor | 343/791 |
| 2,685,068 | 7/1954 | Goubau | 333/240 |
| 2,706,778 | 4/1955 | Walters | 343/790 |
| 2,774,044 | 12/1956 | Silvey et al. | 333/225 |
| 3,134,951 | 5/1964 | Huber et al. | 333/240 |
| 3,364,491 | 1/1968 | Stohr | 343/807 |
| 3,496,567 | 2/1970 | Held | 343/707 |
| 3,566,317 | 2/1971 | Hafner | 333/240 |
| 3,588,754 | 6/1971 | Hafner | 333/240 |
| 3,792,385 | 2/1974 | Napoli et al. | 333/224 |
| 4,185,289 | 1/1980 | DeSantis et al. | 343/898 |
| 4,278,955 | 7/1981 | Lunden | 333/240 |
| 4,387,377 | 6/1983 | Kandler | 343/909 |

*Primary Examiner*—Eli Lieberman
*Assistant Examiner*—Michael C. Wimer
*Attorney, Agent, or Firm*—Christensen, O'Connor Johnson & Kindness

[57] ABSTRACT

An antenna, suitable for being deployed from an aircraft or other vehicle and characterized by broadband, omnidirectional radiation/reception is provided by a coaxial transmission feed line that is terminated by an electrically conductive ball that is electrically and mechanically connected to an extension of the center conductor of the coaxial line, and by a telescopically adjustable sleeve choke having the end adjacent the ball conductor, electrically bonded to the outer conductor of the coaxial line. The choke is adjusted in length to form a matched counterpoise to the ball radiator. The diameter of the ball, the gap length corresponding to the length of the inner conductor between the ball and the terminus of the outer conductor of the line, as well as the length of the sleeve choke, are selected so that the diameter of the ball is greater than one-quarter of the midband wavelength and less than five eighths of the midband wavelength, the gap length between the ball radiator and the terminus of the outer coaxial conductor is less than one-eighth of the midband wavelength, and the choke length is approximately equal to the midband wavelength.

5 Claims, 8 Drawing Figures

AIRCRAFT TRAILING BALL ANTENNA

BACKGROUND

The invention relates to antenna configurations and more particularly to antennas for operating in the ultra-high and above frequency bands, covering an octave or more in bandwidth and having substantially omnidirectional radiation/reception characteristics.

There are applications for transmitting and/or receiving antennas that are highly efficient, capable of operating over a bandwidth of an octave or more, and are omnidirectional, that is, have substantially uniform transmission and reception characteristics in three dimensional space, as compared to the more usual antenna design which seeks high gain in a particular direction or directions. For example, these properties are desirable in certain types of antennas carried by aircraft for communication and surveilance. The substantially omnidirectional characteristics of the antenna allow reception and transmission at uniform signal levels in nearly all directions in the three-dimensional airspace surrounding the center of the aircraft antenna. The broadband feature permits the antenna to operate effectively over a wide spectrum of frequencies without the limitations that accompany tuned, narrow band antennas and antennas of only moderate bandwidth, i.e., substantially less than an octave.

Thus, one purpose of the invention is to provide an aircraft-carried antenna having the omnidirectional and wideband properties. Furthermore, it is desirable to have an antenna configuration that is easily deployed from the aircraft body, such as by means of a trailing wire passed through an opening in the body and towed by the aircraft. The antenna structure, when connected to such a trailing wire, should have a geometry that creates minimal aerodynamic drag and has stable flight characteristics.

Although numerous antenna designs exist for a wide variety of applications including, in some cases, antennas that exhibit certain, but not all of the features noted above, none have been found completely suited to the above requirements. A common shortcoming of existing antenna structures is their narrow band properties, in which the antenna has been carefully constructed to operate over a selected, relatively narrow bandwidth or, in other words, a tuned antenna. Also, most available antennas are designed with a moderate to high gain to focus the transmission and reception of the antenna in a particular direction or directions, whereas in the present application a wholly nondirectional (or omnidirectional) characteristic is desired. Still another disadvantage of existing antenna designs that might otherwise satisfy at least some of the above-noted requirements, is the manufacturing cost of such special-purpose antenna configurations. The more exotic the antenna geometry becomes, the greater the cost of manufacture. Also, the antenna design may attain some of the features desired, but prove very inefficient and/or cumbersome and, hence, impractical.

SUMMARY OF THE INVENTION

The antenna of the invention is supported at an end of a coaxial transmission feed line that in one embodiment is deployed through a small opening in the body of an aircraft, or other vehicle, and towed as a trailing wire. The upstream end of the coaxial cable is coupled to the transmitter and/or receiver carried onboard the aircraft or other vehicle. At the trailing end of the coaxial feed line, the inner conductor of the line is extended slightly beyond the terminus of the outer conductor and the inner conductor is electrically and mechanically connected to an electrically conductive ball that functions as a broadband, omnidirectional radiator (and/or receptor). Serving as a counterpoise to the ball radiator, an adjustable sleeve choke is coaxially mounted on the end of the coaxial line and electrically bonded to the outer conductor of such line and tuned to minimize reflections of electrical energy back along the line toward the transmitter and/or receiver. The diameter of the conductive ball, the length of the inner conductor in the gap between the ball circumference and the terminus of the outer conductor of the transmission, as well as the length of the adjustable sleeve choke are interdependent variables that together are selected in accordance with the following constraints to achieve the broadband, omnidirectional, low-loss characteristics of the antenna. The ball diameter ($d_b$) is selected to be greater than one-quarter and less than five-eighths of the midband wavelength ($\lambda_{midband}$); the length ($l_g$) of the gap, i.e., the length of the inner conductor extends beyond the terminus of the outer conductor to the circumference of the conductive ball, is selected to be greater than $\lambda_{midband}/16$ and less than $\lambda_{midband}/8$; and the choke length ($l_{ch}$) is adjusted empirically to cause optimum matching of the transmission line to the antenna, which is estimated to occur at $l_{ch}$ approximately equal to one $\lambda$midband wavelength. Furthermore, the combined gap length $l_g$ plus ball diameter $d_b$ is selected to form a relatively small overall length to diameter ratio, compared to a thin wire dipole, so as to form a "squat" shaped dipole that greatly expands the bandwidth characteristics. Specifically, this ratio of overall length to diameter is selected to be less than 2/1 for the subject antenna, compared to a typical ratio of 200 for a thin wire dipole.

The resulting antenna configuration has proved useful as a broad-band, omnidirectional, low-loss, lightweight, compact antenna especially suited for the above-noted applications. Furthermore, the construction of the antenna is quite simple in that a standard, commercially available coaxial transmission line is simply fitted with the conductive ball and adjustable sleeve choke, and, hence, the cost of manufacture is significantly less than many existing antenna configurations and thus is exceptionally cost effective in a wide variety of antenna applications.

In a particular and preferred embodiment disclosed in greater detail hereinafter, this omnidirectional antenna configuration has produced a broadband operation covering an octave or more in bandwidth in the 6 to 12 gigaHertz frequency range while providing a very low-loss and, hence, efficient antenna system. The antenna configuration exhibits minimal aerodynamic drag when deployed from an aircraft. The coaxial cable may be, and preferably is, a conventional, vinyl-jacketed, standard transmission coax that is readily deployed as a trailing wire through a small aperture in the aircraft body.

In an alternative embodiment, a polarizing structure is fitted around the antenna ball and sleeve choke to modify the nominal, axial polarization that the basic antenna exhibits, to cause the antenna to radiate and receive circular or slant polarization in order to encompass both vertical and horizontal electric wave components.

To provide a complete disclosure of the invention, reference is made to the appended drawings and following description of particular embodiments, including a preferred embodiment and an alternative embodiment.

DETAILED DESCRIPTION OF PREFERRED AND ALTERNATIVE EMBODIMENTS

Figure 1:
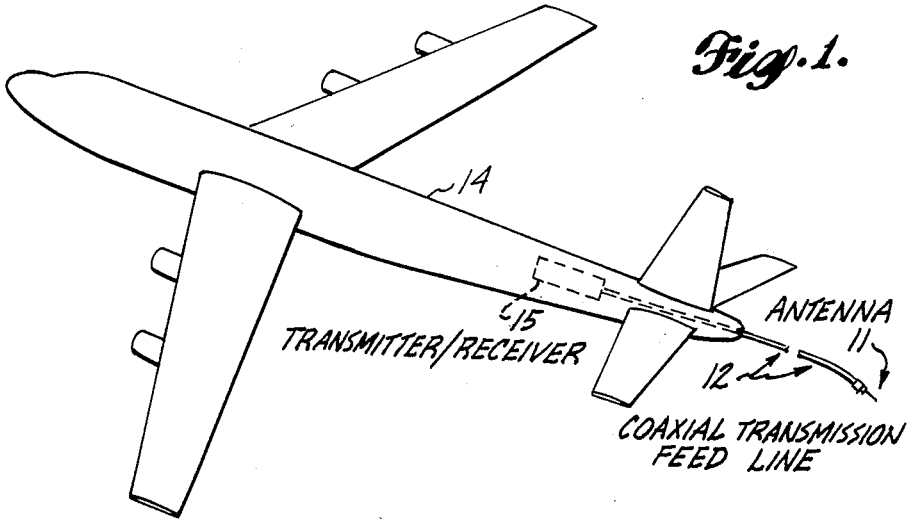
FIG. 1 is a pictorial, isometric view of the preferred embodiment of the antenna in accordance with the invention deployed at the end of a trailing wire in the form of the coaxial transmission feed line to which the antenna is coupled.
Figure 2:
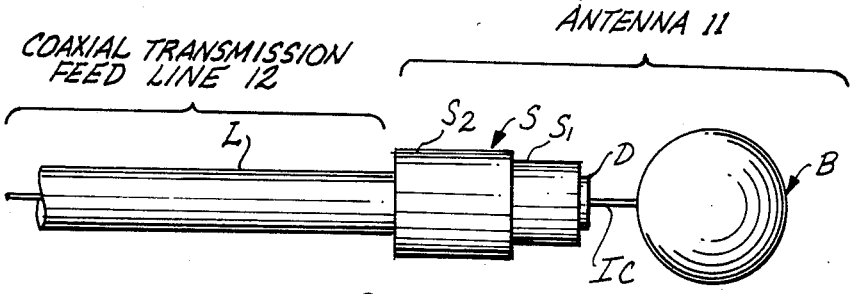
FIG. 2 is a side view in elevation of the antenna and associated coaxial transmission line at a scale of approximately two times the actual antenna size of the preferred embodiment.
Figure 3:
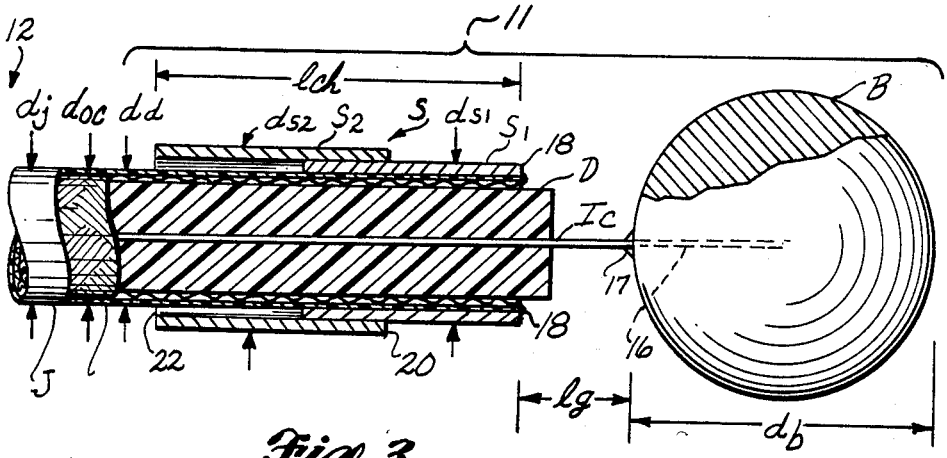
FIG. 3 is a side view corresponding to FIG. 2 but shown at approximately four times the actual size and with portions of the antenna and associated coaxial feed line broken away and sectioned for clarity.

FIGS. 1, 2, and 3 illustrate a preferred embodiment of the invention, in which broadband, omnidirectional, low-loss antenna 11 is coupled to the trailing end of a coaxial transmission feed line 12 deployed from the tail section of aircraft 14. A transmitter and/or receiver 15 (hereinafter referred to as transmitter 15) carried within the body of aircraft 14 is coupled by conventional means to the leading end of line 12 so that transmit power is applied to antenna 11 for radiation therefrom without significant loss or radiation leakage along line 12 between the body of aircraft 14 and antenna 11. While not shown in detail, line 12 may be deployed through a small aperture in the tail section of aircraft 14 of sufficient size to just accommodate the diameter of line 12; and the deployable length of line 12 may be stored by coiling or other well-known means of storage within the body of aircraft 14 when the antenna is retracted.

With reference to FIG. 2, antenna 11 is of a relatively simple, easily and economically manufactured structure comprising a conductive ball B electrically and mechanically connected to an end of inner conductor IC that protrudes beyond the terminus of the line's outer conductor OC (see FIG. 2), and a tunable sleeve choke S coaxially mounted on line 12 with the axial end of choke S adjacent ball B being electrically connected to the end of the outer conductor OC of line 12. As described in greater detail herein, conductive ball B and the end of inner conductor IC act as a round "squat" dipole of relatively small length to diameter ratio for producing broadband, substantially omnidirectional radiation characteristics, and sleeve choke S functions as a dipole counterpoise to ball B blocking wave energy from being reflected back upstream on line 12 toward transmitter 15. In other words, choke S matches coaxial line 12 to the impedance characteristics of ball B.

The diameter of ball B, the gap $l_g$ between the ball circumference and the electrical junction between choke S and the terminus of outer conductor OC of line 12, and the choke length $l_{ch}$ of choke S are the principal design parameters that determine impedance and bandwidth characteristics of antenna 11. In general, exceptionally wide bandwidths have been achieved with this configuration, and in this preferred embodiment, having the specifications given below, the antenna 11 has achieved a one-octave bandwidth over the frequency range of 6 to 12 gigaHertz. Losses for this antenna are very low, and the geometry of the antenna structure has minimal aerodynamic drag, a desirable feature when deployed from aircraft 14 as shown in FIG. 1. Antenna 11 is also relatively compact and light in weight when compared to other broadband antenna configurations. Furthermore, since sleeve choke S serves as a counterpoise to the radiating dipole of conductive ball B, a ground plane is not needed for effective operation of antenna 11. This feature eliminates difficulties encountered in using the body of aircraft 14 as a ground plane. Also, this enables antenna 11 together with a coaxial feed line to be deployed in other environments in which a ground plane is not available or practical such as in the case of other mobile stations, such as ground vehicles and watercraft.

Referring to FIG. 3, which shows antenna 11 and transmission line 12 in greater detail, ball B is sphere, in this instance, solid and made of a relatively good electrical conductor such as brass, as in this embodiment, or copper, aluminum, silver, or gold. The ball may be solid as in the present embodiment, or hollow with the exterior surface made of one or more of the conductive metals mentioned above. The solid brass ball B is drilled along a radius indicated at 16 to receive the protruding end of inner conductor IC of line 12 and, when so inserted, the inner conductor IC may be soldered or brazed in place as indicated at fillet 17 to form a strong mechanical and good electrical bond to the conductive ball B.

Tunable sleeve choke S is formed of two tubular sections including a fixed section S1 and a slidable and, hence, adjustable section S2 telescopically fitted over the outer surface of fixed section S1. Both sections S1 and S2 of choke S are made of a metal that is a good electrical conductor such as brass in the present embodiment, or alternatively, of any one or more of the other metals mentioned above for ball B. The axial end of choke section S1 proximate ball B is electrically bonded, such as by soldering or brazing, to the terminus of the outer conductor OC of coaxial line 12 as indicated by junction 18 which extends circumferentially about choke section S1 and outer conductor OC. The axial length of choke section S1 is sufficient to overlap with the telescopically slidable choke section S2 so that the overall length of the choke is adjustable on either side of the final choke length $l_{ch}$ at which optimum impedance matching is achieved between line 12 and antenna 11.

When choke S has been tuned for optimum antenna performance over the design bandwidth of the antenna, then a circumferential fillet (not shown) of braze or solder will be applied to choke sections S1 and S2 at location 20 adjacent the overlap in order to fix the choke length at an optimum $l_{ch}$. The inside diameter of the fixed choke section S1 is just sufficient to slip over a vinyl jacket J of coaxial line 12. Jacket J thus provides the essential electrical insulation between the inside wall of choke section S1 and the outer conductor OC of line 12 which, in this embodiment, is a braided, tinned copper conductor of the usual type found in standard coaxial transmission lines. Slidable choke section S2 is likewise electrically insulated from the outer conductor OC of line 12 by vinyl jacket 12 and by an airspace 22 equal to the wall thickness of fixed choke section S1. Airspace 22 plus the thickness of vinyl jacket J should not exceed one-tenth $\lambda_{midband}$ in order for the choke S to function properly in blocking reflected wave energy. Choke sections S1 and S2 are, of course, electrically connected both by the telescopic fit at the overlap and after the choke is tuned by the fillet of braze or solder applied at location 20.

As mentioned above, the principal design parameters of antenna 11 are the diameter of ball B, the length of choke $l_{ch}$, and the gap $l_g$ between the point at which inner conductor IC meets the circumference of ball B and the axial terminus of the transmission line where outer conductor OC is electrically joined at 18 to choke section S1. To ensure that the solid dielectric D is effective in the region of coaxial line 12 at the terminus of outer conductor OC and, hence, within gap $l_g$, dielectric D is extended slightly beyond the axial terminus of the outer conductor OC as illustrated in FIGS. 1 and 2.

The conductive ball B connected to the inner conductor of the coaxial line 12 with a gap $l_g$ spacing the ball circumference from the terminus of outer conductor OC, results in the conductive surface of ball B acting as a dipole with radiation therefrom outwardly into the three-dimensional space surrounding the ball with nearly equal radiation strength, except for a sharp null along the axis of line 12 and a shallow null off the diametrically opposed surface of ball B. The ball diameter $d_b$ is selected to be relatively large compared to the diameter of inner conductor IC, i.e., $d_b$>than 10 times the diameter of the inner conductor IC so that in combination with the above-mentioned small ratio of overall dipole length to diameter, the exceptionally wide bandwidth is achieved. The length of gap $l_g$ is chosen to be relatively smaller than the ball diameter $d_b$ so that the voltage and current distribution on the radiating portion of the antenna is distributed around the surface of ball B and is not confined to the straight section of inner conductor IC that protrudes from coaxial line 12. This design feature of antenna 11 is to be contrasted with other antenna configurations in which a ball or other round object is disposed at the end of an antenna wire or rod for the purpose of top loading of the antenna or as a mere weight, for example, to give a flexible wire line flight stability when deployed from an aircraft. More specifically, the foregoing parameters must meet certain further constraints in order for the antenna 11 to produce the desired properties of omnidirectional, wideband and low-loss transmission and reception. These design parameters are quantified in the following sets of formulas that establish the limits of these parameters:

$$\frac{\lambda_{midband}}{4} < d_b < \frac{5\,\lambda_{midband}}{8}; \quad (1)$$

$$\text{where } \lambda_{midband} \simeq \frac{\lambda_l - \lambda_u}{2},$$

and $\lambda_l$=wavelength of lower bandwidth limit, and $\lambda_u$=wavelength at upper bandwidth limit.

$$\frac{\lambda_{midband}}{16} < l_g < \frac{\lambda_{midband}}{8} \quad (2)$$

where $l_g$=length of axial gap between end of coaxial line and circumference of ball B;

$$(d_b + l_g) < \tfrac{3}{4}\lambda_{midband} \quad (3)$$

$$\frac{(d_b + l_g)}{d_b} < 2 \quad (4)$$

$$\lambda_u > l_{ch} > \lambda_l, \text{ or } l_{ch} \simeq \lambda_{midband} \quad (5)$$

where $l_{ch}$ is length of sleeve choke S; and, $$50 \text{ ohms} \leqq Z_o \leqq 200 \text{ ohms} \quad (6)$$

where $Z_o$=impedance of coaxial transmission line.

Referring to equation (1) above, the ball diameter $d_b$ is selected to lie between one quarter and five-eighths of the wavelength at midband; in equation (2), the gap length $l_g$ is selected to be less than one-eighth of the midband wavelength, hence, less than the ball diameter $d_b$, but greater than one-sixteenth of the midband wavelength; in equation (3), the overall dipole length $l_g$ plus $d_b$ is less than five-eighths the midband wavelength; in equation (4), the overall length ($l_g$+$d_b$) to diameter $d_b$ ratio is less than 2; in equation (5), the length $l_{cm}$ of choke S is approximately equal to the midband wavelength; and in equation (6), the impedance $Z_o$ of the coaxial feed line 12 should be equal to or within the limits of 50 ohms and 200 ohms.

While the geometry of ball B is preferably spherical, any rounded conductive object may be used for ball B as long as the asymmetry of the object compared to a perfect sphere is less than one-tenth $\lambda_{midband}$. In other words, a rounded object having some nonspherical aberrations or deformities can be used in lieu of ball B as long as these aberrations do not deviate more than one-tenth $\lambda_{midband}$ from the ideal sphere. Thus, an ellipsoid, or cube, having rounded corners are examples of alternative geometries that may be used for ball B within the above constraints.

In designing an antenna 11 within these constraints, the ball diameter $d_b$ and gap length $l_g$ are the most significant in establishing the antenna impedance. An increasing ball diameter $d_b$ causes a decrease in the antenna impedance. A decrease in the gap length $l_g$ causes a decrease in the antenna impedance. Since these variables are interdependent, it is necesary to empirically choose a suitable set of variables and measure the antenna performance (see description of FIGS. 4–6) until optimum antenna performance is achieved.

In the preferred embodiment shown in the drawings and described above, an antenna 11 having omnidirectional characteristics and a bandwidth of an octave or more between 6 and 12 gigaHertz was achieved using the following specifications:

ball diameter $d_b$=0.44 inches;

gap length $l_g$=0.1 inches;

choke length $l_{ch}$ approximately=one λ at 9 gigahertz, or ≅1.3 inches;

coaxial line=RG 142 cable having a vinyl jacket and a Teflon (DuPont trademark) dielectric in which $d_j$=0.2 inch; $d_{OC}$=0.187 inch; $d_d$=0.175 inch; the inner conductor IC of coaxial line 12 is a copper-clad steel of 0.039 inches in diameter, and the braided outer conductor OC is a tinned copper;

outside diameter $d_{S1}$ of sleeve section S1=0.25 inches; and outside diameter $d_{S2}$ of sleeve section S2=0.31 inches.

An antenna 11 made to these specifications produced a suitable omnidirectional radiation pattern when deployed on a feed line 12 of from 10 to 15 feet trailing the aircraft.

Figure 4:
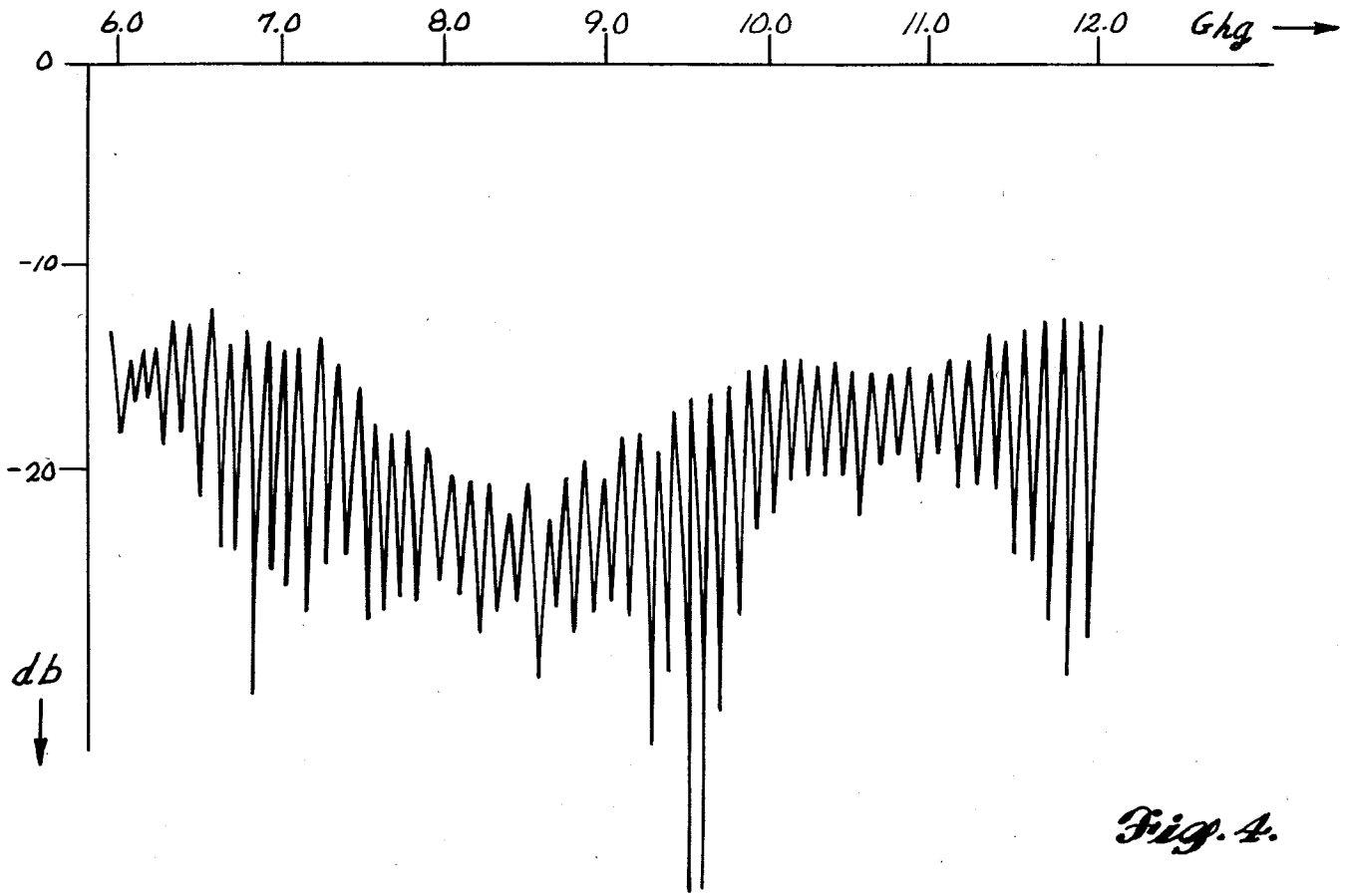
FIG. 4 is a graph of db ratio of signal energy reflected back on the transmission line by the antenna interface, relative to input signal energy, plotted as a function of frequency over the design bandwidth of the antenna.

The efficiency of antenna 11 constructed in accordance with the foregoing specifications and operated over a bandwidth of an octave from 6 to 12 gigaHertz is illustrated in the graph of FIG. 4. The upper and horizontal axis of the graph of FIG. 4 plots the frequency of a transmit signal applied via coaxial line 12 to antenna 11. The vertical axis is a plot of the return losses in decibels that are returned back upstream on coaxial line 12 due to reflections from antenna 11. The larger negative decibels (db) represent decreasingly smaller amounts of reflected power and thus represent increasing antenna efficiency. Over the bandwidth of 6 to 12 gigaHertz, the graph of FIG. 4 shows a variation in return losses of between −12 and −20 db representing an antenna efficiency in the range of 94 to 99 percent. The −12 db of better indicated by the graph in FIG. 4 corresponds to a voltage standing wave ratio (VSWR) of roughly 1.7 to 1.0.

Figure 5:
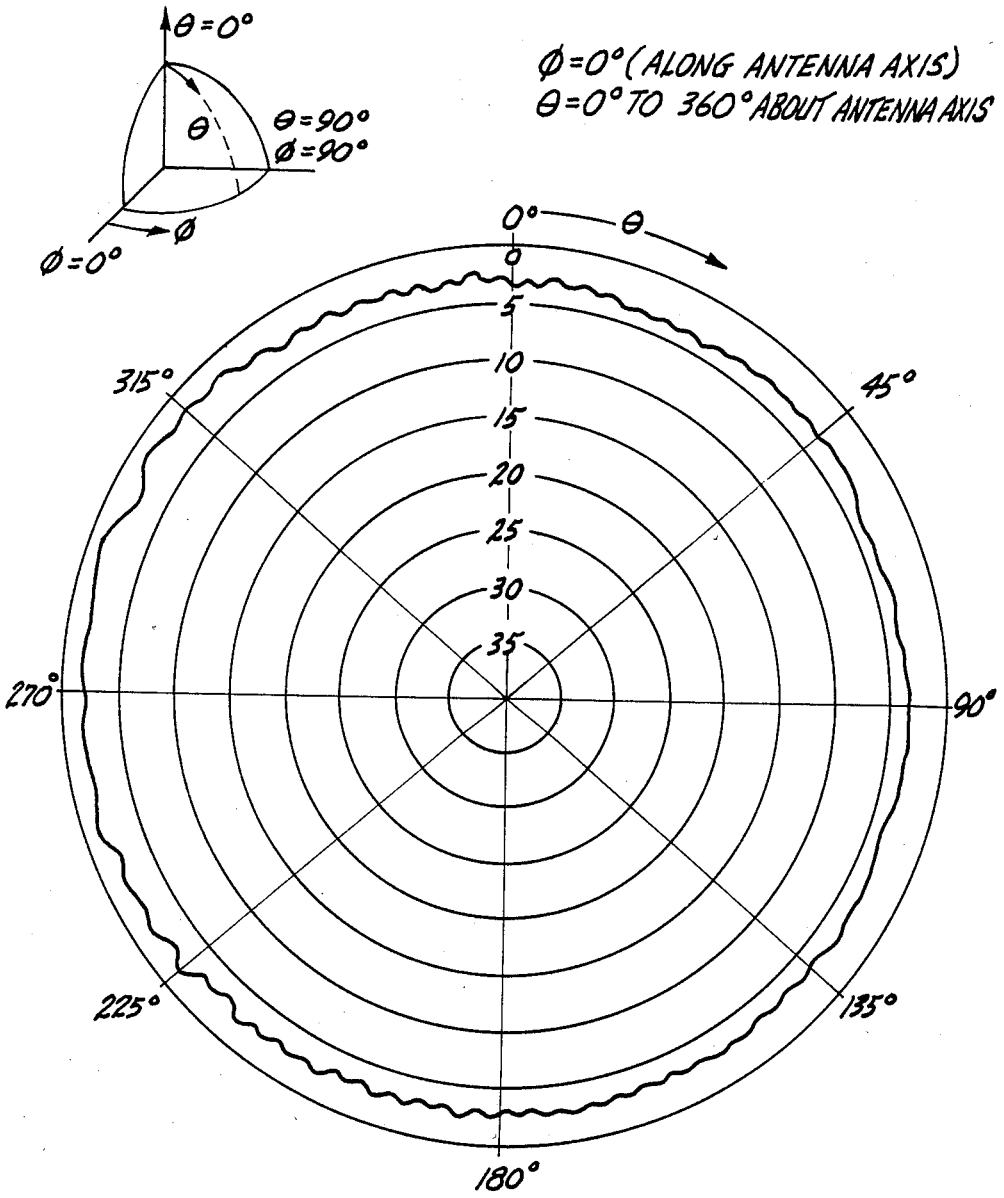
FIG. 5 is a graph of the relative signal strength radiated from the antenna, measured in polar coordinates, showing the uniform radiation of the antenna at measurement points about a circle coaxial with the axis of the antenna feed line.
Figure 6:
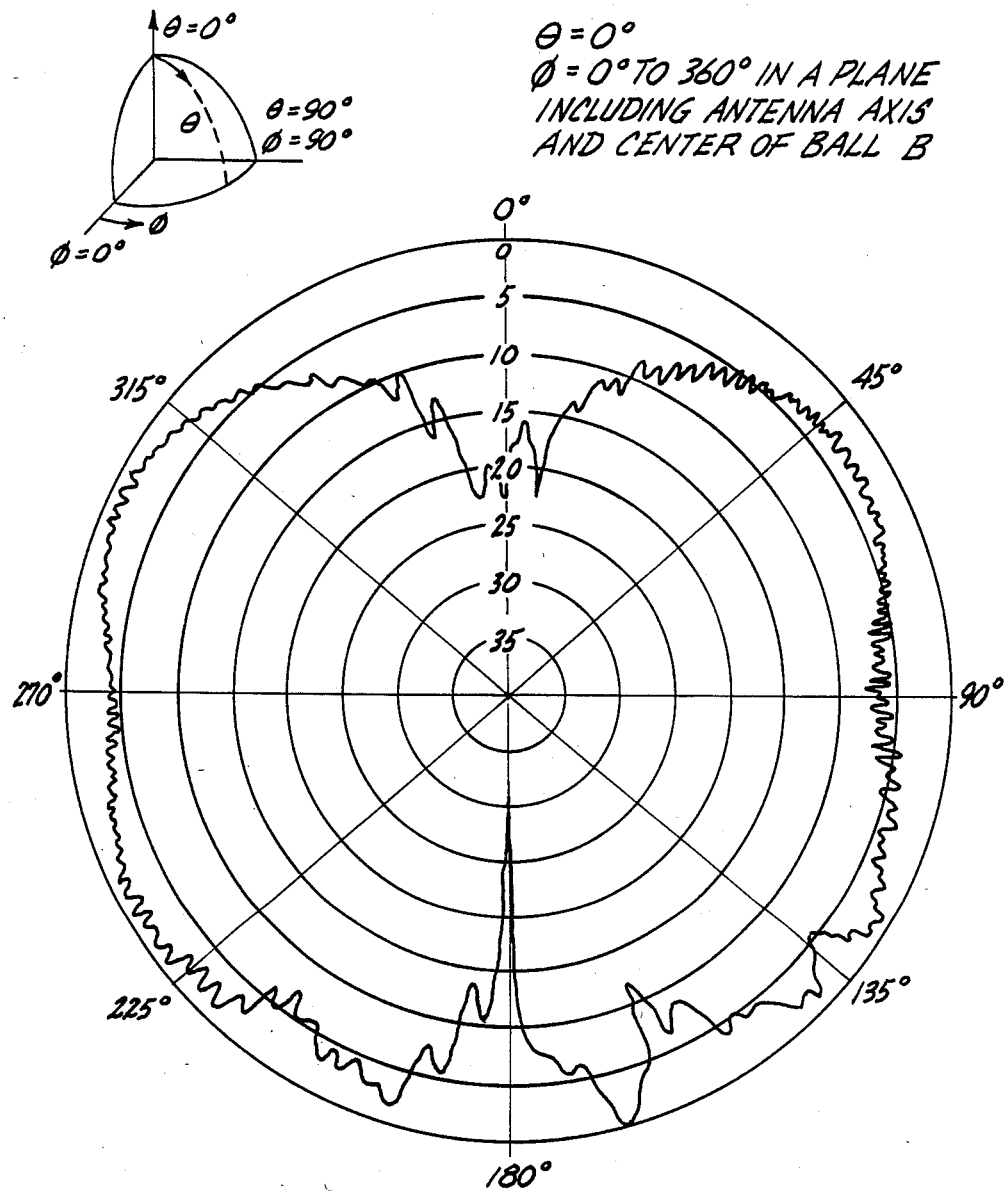
FIG. 6 is another plot, again in polar coordinates, of the relative signal strength of antenna radiation measured at points about a circle lying in a plane that includes the antenna transmission line axis and the ball center, showing a generally uniform, nondirectional radiation pattern except for a sharp null as the reference circle crosses the transmission line axis.

FIGS. 5 and 6 are polar coordinate plots of the omnidirectional radiation characteristics from antenna 11 when constructed in accordance with the foregoing specifications. In particular, FIG. 5 is a plot of the radiation pattern measured at points in a 360° circle around the axis of the coaxial cable at a radius lying outside the diameter of the spherical ball. FIG. 6 is a plot of the radiation pattern around a circle of 360° in a plane that includes the axis of coaxial line 12 and the center of the spherical ball B. Both polar coordinate plots of FIGS. 5 and 6 were measured at a midband frequency of 9 gigaHertz. Similar patterns were obtained over the entire bandwidth of frequencies from 6 to 12 gigaHertz. Note in FIG. 6, the sharp null at 180° which coresponds to radiation away from the center of ball B along the axis of coaxial line 12, which as expected shows relatively little antenna radiation. There is another null, but of only slight magnitude along the 0° axis, which corresponds to the radiation outward from the area of ball B lying diametrically opposite from line 12.

Thus, by combining the radiation strength plots shown in FIGS. 5 and 6, it will be appreciated that the antenna has a nearly omnidirectional, toroidal pattern with a very sharp and deep null along the axis of the feed line 12, and a less pronounced null along the antenna axis in a direction away from coaxial line 12.

Figure 7:
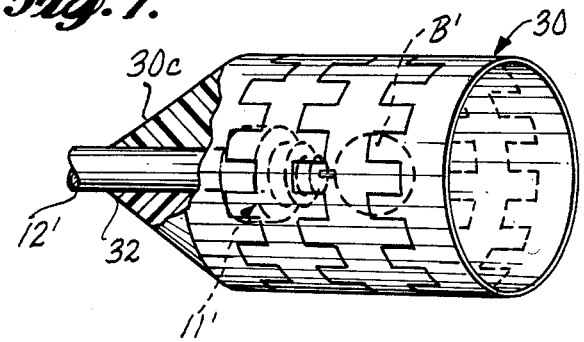
FIG. 7 is an isometric view of an alternative embodiment of the antenna of FIGS. 1 through 3 in which a polarizer is mounted on the antenna and coaxial feed line so as to surround the antenna and modify the polarization of the waves radiated and received thereby.
Figure 8:
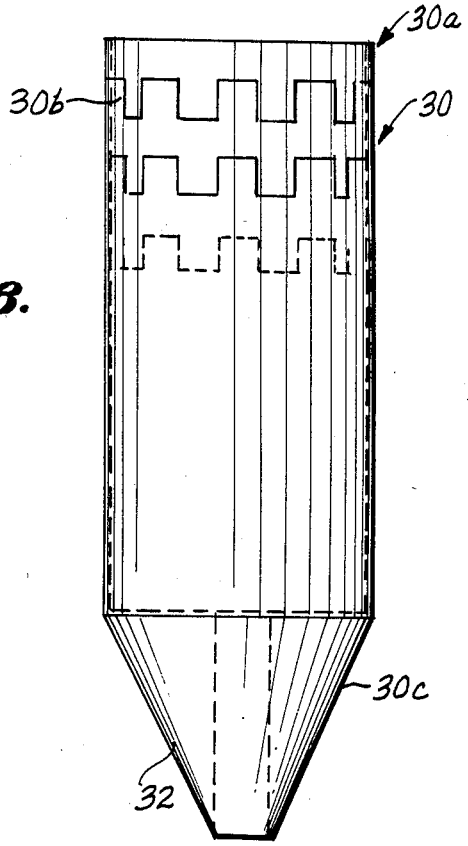
FIG. 8 is a slightly enlarged, plan view of the polarizer of FIG. 7 shown apart from the antenna and coaxial feed line.

With reference to FIGS. 7 and 8, an alternative embodiment of the invention is shown in which antenna 11' mounted at the end of a coaxial transmission line 12' is surrounded by a wave-polarizing structure 30 to modify the sense polarization of the transmitted and/or received waves. More specifically, with reference to FIG. 8, polarized structure 30 is shown to include a thin wall dielectric substrate **30*a* having a plurality of "square wave" shaped conductors 30*b* superimposed on substrate 30*a* and referred to as "meander" lines or conductors. A polarizer structure 30 made in this manner of dielectric substrate 30*a* and "meander" conductors 30*b*, when arranged to surround a radiating element of an antenna, is known per se, to alter the polarization of the radiating electromagnetic waves, but has not used in this particular environment. In this alternative embodiment, the "square wave" shaped meander conductors 30*b* progress circumferentially around dielectric substrate 30*a* and when substrate 30*a* is arraged to coaxially surround the axis of antenna 11' and coaxial 12' as shown in FIG. 7**, the polarization of the radiation from the antenna ball B is changed from axial polarization to slant (or circular) polarization. Slant polarization, as is well known, encompasses both vertical and horizontal (in this case axial) electric wave components and thus enables the transmission and reception of signals that exhibit either or both vertical and horizontal polarization.

Polarizer structure 30 is supported in its position surrounding antenna 11' in a suitable manner such as by the conically shaped dielectric support **30*c* shown in FIGS. 7 and 8. Support 30*c* includes a coaxial throughbore 32 that is dimensioned to form an interference fit with the outer diameter of coaxial cable 12' so that support 30*c* may be fitted snugly over line 12' and positioned adjacent antenna 11' so as to support one axial end of dielectric substrate 30*a* as indicated in FIG. 7**.

While only particular embodiments have been disclosed herein, it will be readily apparent to a person skilled in the art that numerous changes and modifications can be made thereto, including the use of equivalent means and devices without departing from the spirit of the invention defined in the following claims.

The embodiments of the invention in which an exclusive property or privilege is defined are as follows:

1. A transportable antenna comprising:

a movable transport;

mounting means carried by said transport for deploying a coaxial transmission line to serve as an antenna feed, said coaxial transmission line having inner and outer conductors separated by a dielectric and said coaxial transmission line extending from said transport to a terminated end that is spaced outwardly from said transport, said terminated end of said coaxial transmission line having said inner conductor extended axially beyond a terminus of said outer conductor;

a ball-shaped conductor of diameter $d_b$ having its center aligned with the axis of said coaxial transmission line and being electrically connected to the extended end of said inner conductor so that the outer circumference of said ball-shaped conductor is axially spaced from the terminus of said outer conductor of said coaxial transmission line by a gap length of $l_g$;

a sleeve choke coaxially mounted on said transmission line adjacent said terminated end thereof, the circumference of one end of said sleeve choke being positioned in radial registration with and electrically connected to the terminus of said outer conductor, and the opposite end of said sleeve choke extending back along said coaxial transmission line by a choke length $l_{ch}$, said diameter $d_b$ of said ball-shaped conductor, said gap length $l_g$ of said sleeve choke and said choke length $l_{ch}$ being selected with respect to a given midband wavelength of $\lambda_{midband}$ in accordance with the following relationships:

$$\frac{\lambda_{midband}}{4} < d_b < \frac{5\lambda_{midband}}{8};$$

$$\frac{\lambda_{midband}}{16} < l_g < \frac{\lambda_{midband}}{8}; \text{ and,}$$

$$l_{ch} \cong \lambda_{midband}.$$

2. The transported antenna of claim 1, wherein said transport is an aircraft.

3. The transported antenna of claim 2, wherein said aircraft has a body that encloses an interior aircraft compartment adapted to mount transmitter and/or receiver means; said coaxial transmission line at an end thereof opposite from said terminated end being adapted for coupling to a transmitter and/or receiver means within the body of said aircraft, and said body of said aircraft having aperture means opening between the interior of said aircraft body and an exterior of said aircraft body through which said coaxial transmission line is slidably extended to deploy the terminated end of said coaxial transmission line including said ball-shaped conductor and said sleeve choke at an adjustable distance from the body of said aircraft.

4. The antenna of claim 3 further comprising a wave polarizer means mounted to substantially surround said ball-shaped conductor and said sleeve choke for modifying the sense of wave polarization associated with said antenna.

5. The antenna of claim 4, wherein said polarizer means comprises a hollow, tubular dielectric substrate mounted coaxially about and in radial registration with said ball-shaped conductor and said sleeve choke, and meander conductors mounted on and supported by said dielectric substrate, said meander conductors extending circumferentially around said dielectric substrate.

* * * * *

UNITED STATES PATENT AND TRADEMARK OFFICE

CERTIFICATE OF CORRECTION

PATENT NO. : 4,556,889

DATED : December 3, 1985

INVENTOR(S) : Buehler

It is certified that error appears in the above-identified patent and that said Letters Patent is hereby corrected as shown below:

| | | | |
|---|---|---|---|
| Column 6, | line 25: | "$\lambda_u > l_{ch} > \lambda_l$, or $l_{ch} \simeq \lambda_{midband}$" | (5) |
| | should be: | -- $\lambda_u < l_{ch} < \lambda_l$, or $l_{ch} \simeq \lambda_{midband}$-- | (5) |
| | line 41: | "$l_{cm}$" should be --$l_{ch}$-- | |
| Column 7, | line 37: | "of" should be --or-- | |
| | line 53: | "coresponds" should be --corresponds-- | |
| Column 8, | line 4: | "polarized" should be --polarizer-- | |
| | line 12: | after "not" insert --been-- | |
| | line 16: | "arraged" should be --arranged-- | |

Signed and Sealed this

*Eleventh* Day of *March 1986*

[SEAL]

*Attest:*

DONALD J. QUIGG

*Attesting Officer* *Commissioner of Patents and Trademarks*